US010119510B2

(12) United States Patent
Lee

(10) Patent No.: US 10,119,510 B2
(45) Date of Patent: Nov. 6, 2018

(54) DISPENSER NOZZLE FOR HIGH PRESSURE INJECTION

(71) Applicant: Gu-Hwan Lee, Incheon (KR)

(72) Inventor: Gu-Hwan Lee, Incheon (KR)

( * ) Notice: Subject to any disclaimer, the term of this patent is extended or adjusted under 35 U.S.C. 154(b) by 22 days.

(21) Appl. No.: 15/245,246

(22) Filed: Aug. 24, 2016

(65) Prior Publication Data

US 2017/0058850 A1 Mar. 2, 2017

(30) Foreign Application Priority Data

Aug. 31, 2015 (KR) ..... 10-2015-0123105

(51) Int. Cl.

| | |
|---|---|
| ***B05B 1/30*** | (2006.01) |
| ***F02M 61/18*** | (2006.01) |
| ***B05B 1/34*** | (2006.01) |
| ***F02M 61/16*** | (2006.01) |
| ***F02M 69/04*** | (2006.01) |
| ***B05C 11/00*** | (2006.01) |

(52) U.S. Cl.

CPC ..... *F02M 61/18* (2013.01); *B05B 1/3046* (2013.01); *B05B 1/3405* (2013.01); *B05B 1/3442* (2013.01); *B05C 11/00* (2013.01); *F02M 61/162* (2013.01); *F02M 69/041* (2013.01)

(58) Field of Classification Search

CPC .... F02M 61/18; F02M 69/041; F02M 61/162; B05B 1/3405; B05B 1/3442; B05B 1/3046; B05C 11/00

USPC ..... 239/473, 490, 491, 533.11, 533.12, 583, 239/584

See application file for complete search history.

(56) References Cited

U.S. PATENT DOCUMENTS

| | | | | |
|---|---|---|---|---|
| 2,118,194 | A * | 5/1938 | Hukari | B05B 1/3033 239/485 |
| 4,721,253 | A * | 1/1988 | Noguchi | B05B 1/3405 239/533.12 |
| 2004/0129806 | A1* | 7/2004 | Dantes | F02M 51/0685 239/533.12 |
| 2013/0256429 | A1* | 10/2013 | Kobayashi | F02M 61/162 239/488 |
| 2015/0014444 | A1* | 1/2015 | Kobayashi | F02M 61/163 239/461 |

FOREIGN PATENT DOCUMENTS

| | | | |
|---|---|---|---|
| JP | 2005-103373 | A | 4/2005 |
| KR | 10-1089916 | B1 | 12/2011 |

(Continued)

*Primary Examiner* — Steven J Ganey
(74) *Attorney, Agent, or Firm* — IP Legal Services, LLC

(57) ABSTRACT

The present invention relates to a dispenser nozzle for high pressure injection, of which injection pressure and efficiency are largely improved and the product lifespan is increased, and in which a tappet 100 has a leading end portion 101 formed in a conical shape, and a nozzle 110 includes a funnel-shaped accommodation part 111 formed for maintaining a predetermined gap G from an outer circumferential surface of the leading end portion 101 of the tappet 100, a funnel groove 112 formed in the center of a bottom surface 111*a* of the funnel-shaped accommodation part 111 such that the leading end portion 101 of the tappet 100 is inserted into the funnel groove 112 by a predetermined length, and an injection hole 113 penetratingly formed in the center of the funnel groove 112.

2 Claims, 8 Drawing Sheets

(56) References Cited

FOREIGN PATENT DOCUMENTS

| | | | |
|---|---|---|---|
| KR | 10-1165557 | B1 | 7/2012 |
| KR | 10-1175284 | B1 | 8/2012 |
| KR | 10-1190939 | B1 | 10/2012 |
| KR | 10-2013-0076581 | A | 7/2013 |
| KR | 10-2014-0060275 | A | 5/2014 |
| KR | 10-1528720 | B1 | 6/2015 |

* cited by examiner

DISPENSER NOZZLE FOR HIGH PRESSURE INJECTION

RELATED APPLICATION

The present application claims a priority benefit to Korean Patent Application No. 10-2015-0123105 filed on Aug. 31, 2015, which is incorporated herein by reference.

BACKGROUND OF THE INVENTION

Field of the Invention

The present invention relates to a high-precision dispenser nozzle and, more particularly, to a dispenser nozzle for high pressure injection, of which injection pressure and efficiency are largely improved and the product lifespan is increased.

Background Art

As is generally known, a high-precision dispenser is a device for injecting a predetermined liquid to be dispensed by a predetermined amount through a nozzle so as to precisely apply a set amount of the liquid to a corresponding position of a target object, and typically used to carry out coating or joining of a predetermined portion in a precision industry field such as the manufacturing of semiconductor devices, mobile phones and the like.

Hereinafter, a structure of a typical dispenser will be reviewed with reference to the accompanying drawings.

Figure 1:
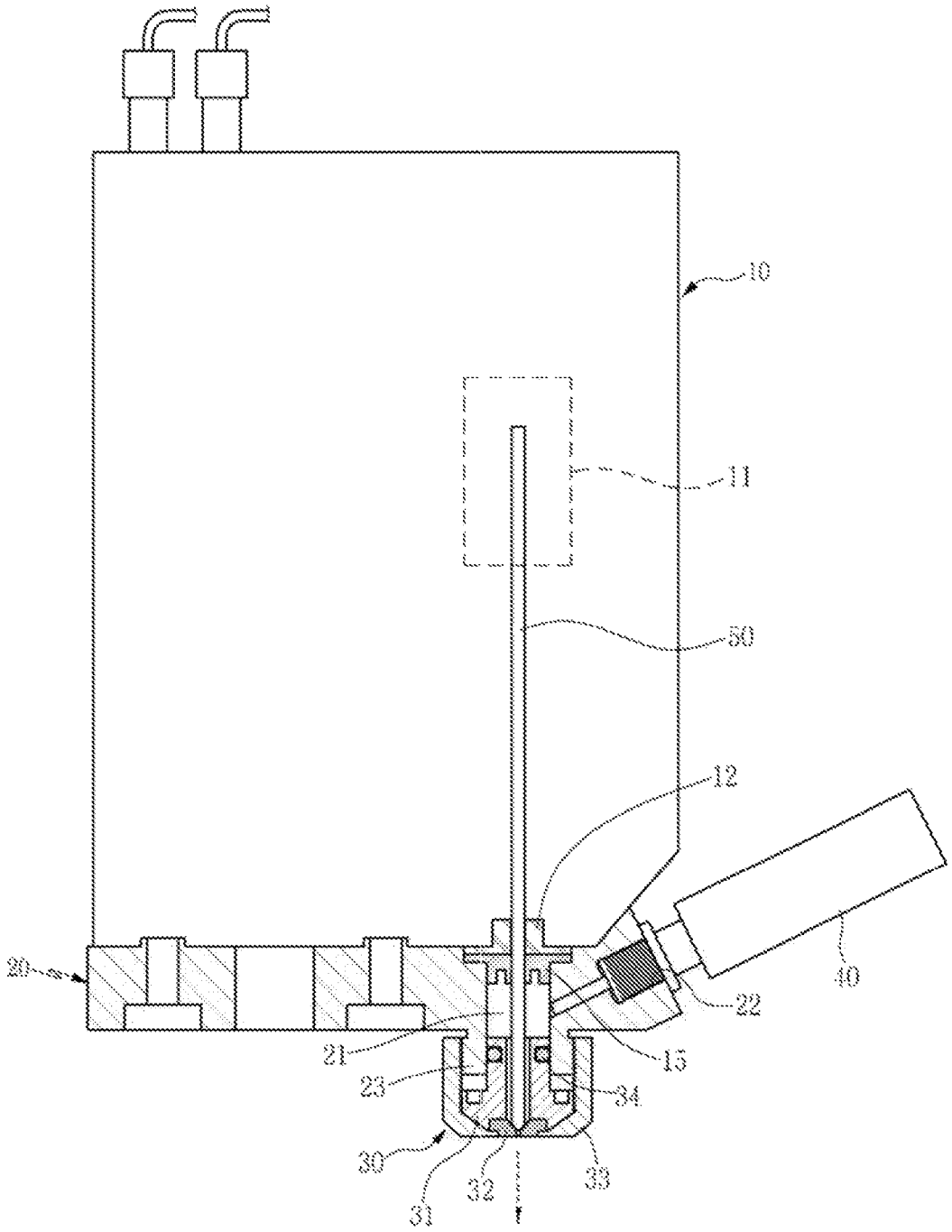

Referring to FIG. 1, a dispenser includes a driving part 10, a coupling part 20 mounted on the bottom surface of the driving part 10, a nozzle part 30 mounted at the lower portion of the coupling part 20, and a syringe part 40 mounted on a side surface of the coupling part 20.

Further, a tappet 50, which carries out vibrational back and forth motion, is provided to the lower end of the driving part 10 so as to be exposed, wherein the tappet 50 is formed to be inserted into an introduction hole 21 of the coupling part 20 through a centering piece 12 and a sealing member 15.

Meanwhile, the coupling part 20 includes the introduction hole 21, into which the tappet 50 of the driving part 10 is inserted, a coupling portion 23, which is formed on the bottom surface thereof so as to be provided and coupled with the nozzle part 30, and a mounting hole 22, which is formed at one side so as to be provided and coupled with the syringe part 40.

In addition, the coupling part 20 has structure, in which liquid to be dispensed, which is supplied through the syringe part 40, is introduced into the introduction hole 21.

Figure 2:
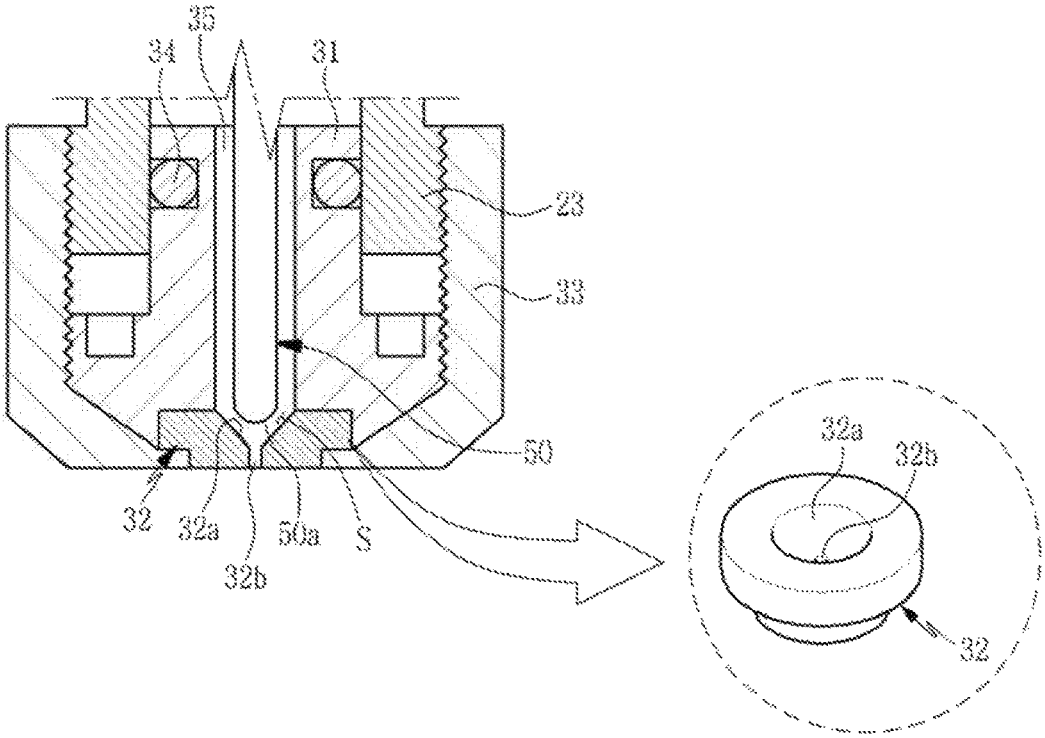

Referring to FIG. 2, the nozzle part 30 includes a guidance 31, which is inserted into the coupling portion 23 of the coupling part 20 through an O-ring 34, a nozzle 32, which is inserted and provided into the bottom surface of the guidance 31, and a cover portion 33 for covering the guidance 31 and the nozzle 32 and fixedly coupled with the coupling portion 23 of the coupling part 20.

the nozzle has a funnel-shaped accommodation part 32*a* formed in the center thereof, and an injection hole 32*b* formed in the center of the funnel-shaped accommodation part 32*a* such that the liquid to be dispensed is discharged and injected through the injection hole 32*b*.

The operations of the dispenser described as above will be reviewed hereinafter.

First, as predetermined power (pulse wave forms) is applied to a vibration means 11 in the driving part 10 so as to operate the driving part 10, the vibration means 11 is driven so that the tappet 50 vibrates in association with the vibration means 11.

Meanwhile, the syringe part 40, which is filled with the liquid to be dispensed, is provided to the mounting hole 22 of the coupling part 20. Then, the liquid to be dispensed is introduced into the introduction hole 21 of the coupling part 20 and accommodated in the accommodation part 32*a* of the first space part 35 of the guidance 31, which is penetrated by the tappet 50.

Herein, the liquid to be dispensed is not discharged to the outside through the injection hole 32*b* of the nozzle 32, because the diameter of the injection hole 32*b* is very fine and the liquid to be dispensed has a predetermined level of viscoelasticity and thus is not leaked to the outside by gravity.

Figure 3A:
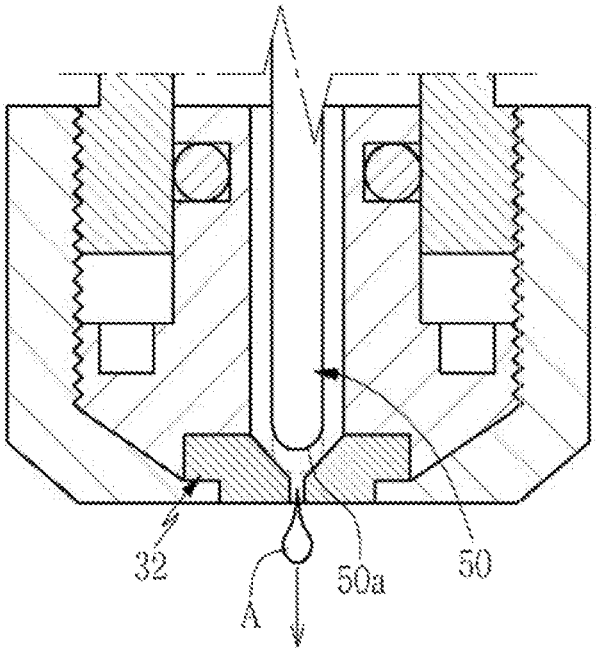

In this state, if the tappet 50 instantly moves downwards and the leading end portion 50*a* thereof comes into contact with the surface of the accommodation part 32*a*, as shown in FIG. 3*a*, by the above-mentioned operation of the vibration means 11, then the liquid to be dispensed A, which stays in the accommodation part 32*a*, is injected to the outside through the injection hole 32*b*.

However, in the discharging injection of the liquid to be dispensed A as above, there have been the demand and necessity of increasing the injection pressure of the liquid to be dispensed A recently.

The components of the liquid to be dispensed may be varied according to the purpose to be carried out and, in the case of epoxy use, even higher pressure injection is required due to the viscosity or thixotropic index thereof.

Figure 3B:
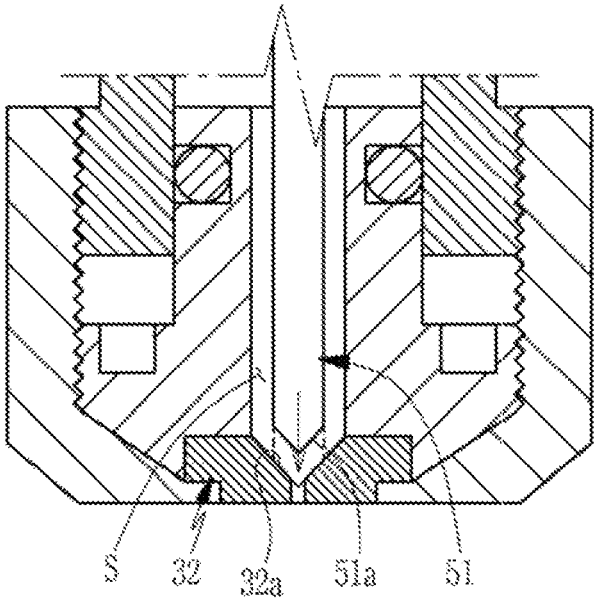

Therefore, according to the prior art, in order to increase the injection pressure of the liquid to be dispensed, there has been suggested a technique, in which the leading end portion 51*a* of a tappet 51 is sharply processed so as to decrease a contact area between the leading end portion 51*a* and the liquid to be dispensed A, thereby relatively increasing the injection pressure, as shown in FIG. 3*b*

However, even though the injection pressure is increased by the above structure of the tappet 51, there is another problem that the liquid to be dispensed A cannot be smoothly introduced into a space part S between the tappet 51 and the accommodation part 32*a* during the vibration motion of the tappet 51.

This is because that the outer circumferential surface of the leading end portion 51*a* of the tappet 51 and the inner circumferential surface of the accommodation part 32*a* are conform with each other, wherein when the tappet 51 moves backwards after the contact with the accommodation part 32*a*, the liquid to be dispensed, which is filled in the space part S, can be introduced into the accommodation part 32*a* of the nozzle 32 only when a certain interval is generated between the tappet and the accommodation part.

This phenomenon leads to the deterioration of the injection performance due to the shortage of the quantitative liquid to be dispensed, which is introduced into the accommodation part 32*a*.

PRIOR ART DOCUMENTS

Patent Documents

Patent Document 1: Korean Patent Publication No. 10-1190939

Patent Document 2: Korean Patent Publication No. 10-1165557

Patent Document 3: Korean Patent Publication No. 10-1175284

Patent Document 4: Korean Patent Laid-Open Publication No. 10-2013-0076581

SUMMARY OF THE INVENTION

Accordingly, the present invention has been made to solve the above-mentioned problems occurring in the prior arts, and it is an objective of the present invention to provide a dispenser nozzle for high pressure injection, of which injection pressure and efficiency are largely improved and the product lifespan is increased.

To accomplish the above objective, according to the present invention, there is provided a dispenser nozzle for high pressure injection, applied to a dispenser which includes a driving part, a coupling part and a nozzle part, such that a tappet, which carries out vibration motion and has a leading end portion formed in a conical shape, is mounted on the lower end of the driving part so as to be exposed and inserted into the nozzle part 30 through the coupling part, and the nozzle part is provided with a nozzle on the bottom surface thereof, the nozzle comprising a funnel-shaped accommodation part formed for maintaining a predetermined gap G from an outer circumferential surface of the leading end portion of the tappet, a funnel groove formed in the center of a bottom surface of the funnel-shaped accommodation part such that the leading end portion of the tappet is inserted into the funnel groove by a predetermined length, and an injection hole penetratingly formed in the center of the funnel groove.

Further, a nozzle according to the present invention may include a funnel-shaped accommodation part formed for maintaining a predetermined gap from an outer circumferential surface of the leading end portion of the tappet, a funnel groove formed in the center of a bottom surface of the funnel-shaped accommodation part such that the leading end portion of the tappet is inserted into the funnel groove by a predetermined length, an injection hole penetratingly formed in the center of the funnel groove, and an injection groove formed in the inclined plane of the funnel groove at one side of the bottom surface of the funnel-shaped accommodation part such that liquid to be dispensed is introduced into the funnel groove.

Further, a nozzle according to the present invention may include three first groove portions having a circular shape and formed of a predetermined depth on the upper end portion of a main body so as to be adjacent to each other, a funnel groove formed of a predetermined depth down to a bottom surface in the center portion thereof among the first groove portions such that the leading end portion of the tappet is inserted into and comes into contact with the funnel groove by a predetermined length, an injection hole penetratingly formed in the center of the funnel groove, and a second groove portion formed in the inclined plane of the funnel groove at one side of each of the first groove portions such that liquid to be dispensed is introduced into the funnel groove.

Further, a nozzle according to the present invention may include two first groove portions having a circular shape and formed of a predetermined depth on the upper end portion of a main body so as to be adjacent to each other, a funnel groove formed of a predetermined depth down to a bottom surface in the center portion thereof between the two circles of the first groove portions, which are adjacent to each other, such that the leading end portion of the tappet is inserted into and comes into contact with the funnel groove, an injection hole penetratingly formed in the center of the funnel groove, second groove portions having a circular shape and formed of a predetermined depth inside the first groove portions, and a third groove portion formed in the inclined plane of the funnel groove at one side of each of the second groove portions such that liquid to be dispensed is introduced into the funnel groove.

Further, a nozzle according to the present invention may include a first groove portion having a circular shape and formed of a predetermined depth at one side of the upper end portion of a main body, a funnel groove formed of a predetermined depth down to a bottom surface in the center portion thereof, which includes one side of the first groove portion, such that the leading end portion of the tappet is inserted into and comes into contact with the funnel groove, an injection hole penetratingly formed in the center of the funnel groove, a second groove portion having a circular shape and formed of a predetermined depth inside the first groove portion, and a third groove portion formed in the inclined plane of the funnel groove at one side of the second groove portion such that liquid to be dispensed is introduced into the funnel groove.

As described above, the present invention largely improve the injection pressure and efficiency and increase product lifespan.

BRIEF DESCRIPTION OF THE INVENTION

Figure 4A:
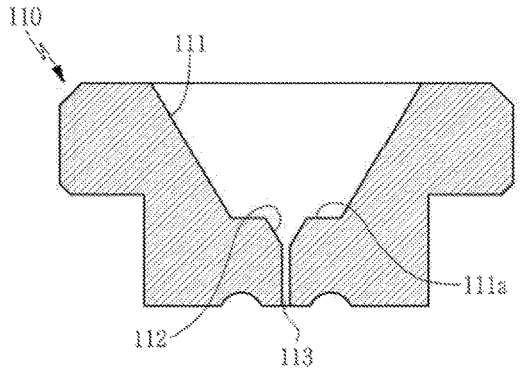
Figure 4B:
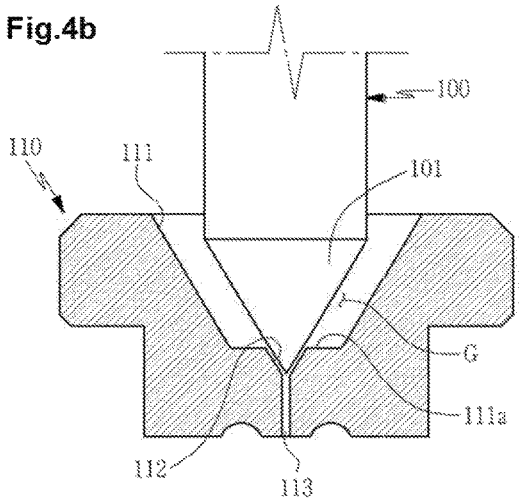
Figure 5A:
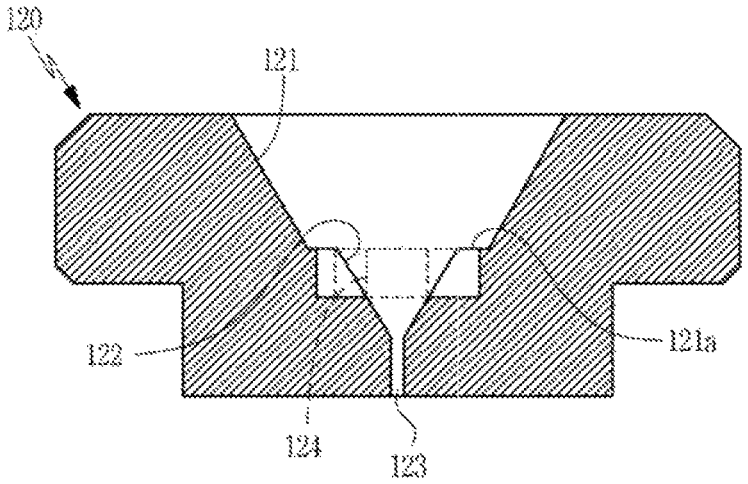
Figure 5B:
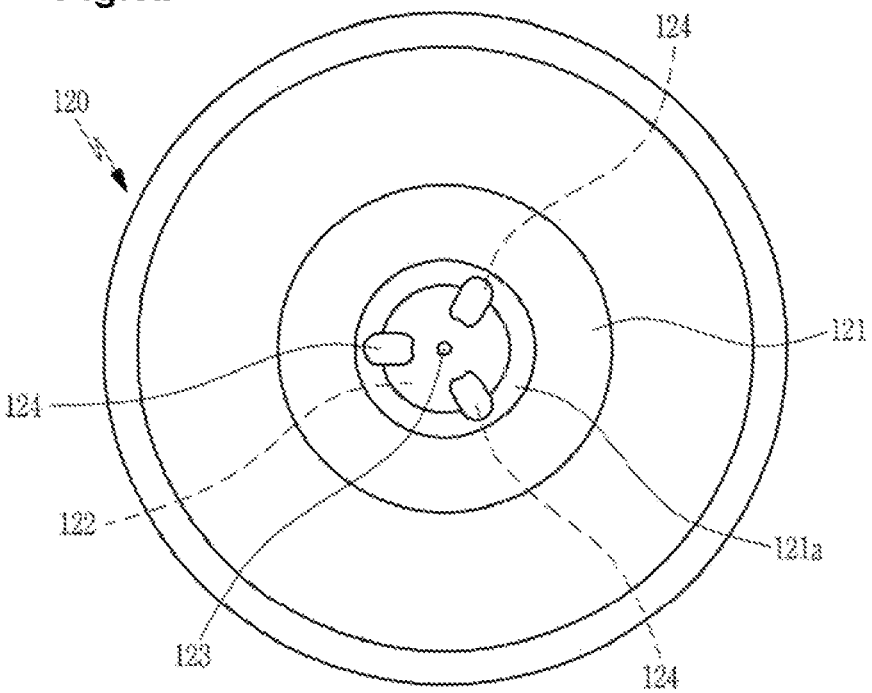
Figure 6A:
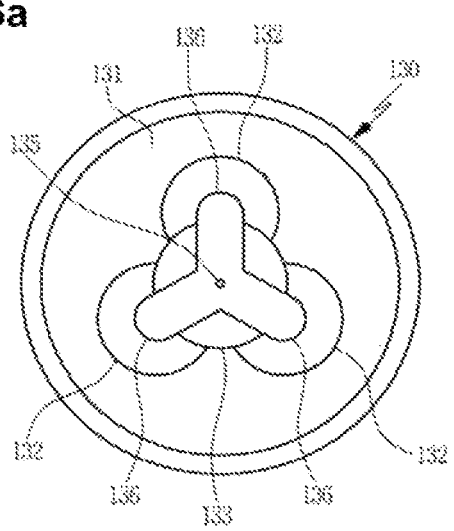
Figure 6B:
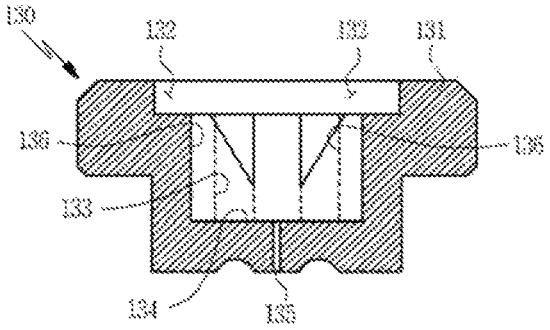
Figure 6C:
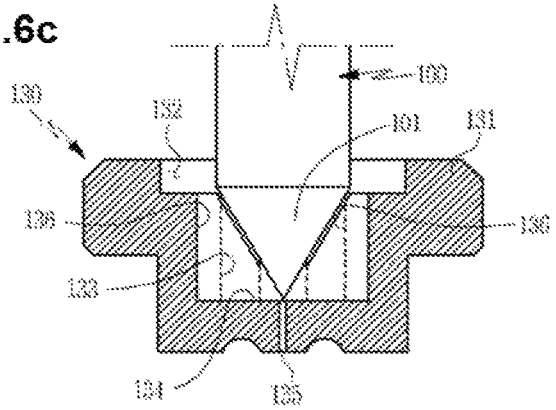
Figure 7A:
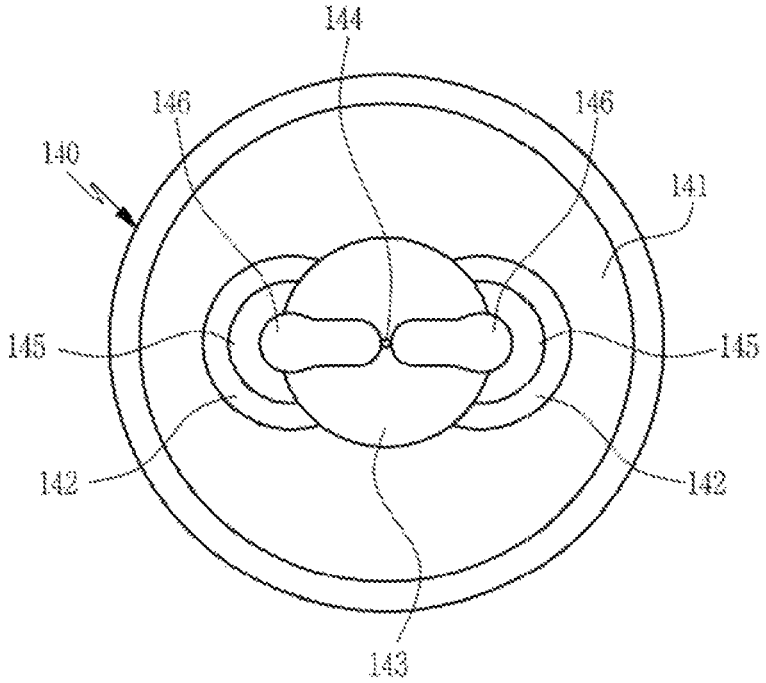
Figure 7B:
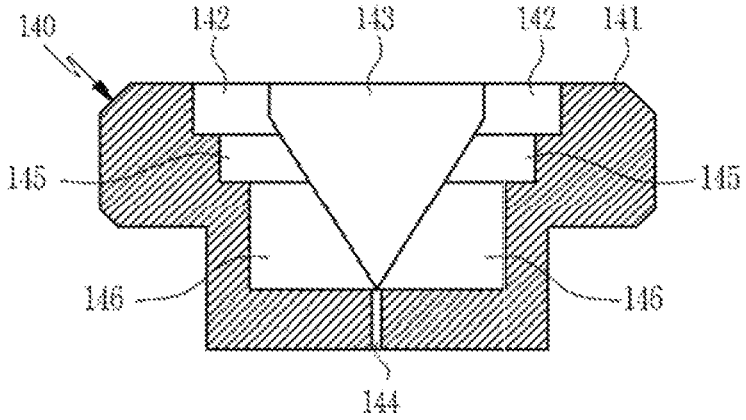
Figure 8A:
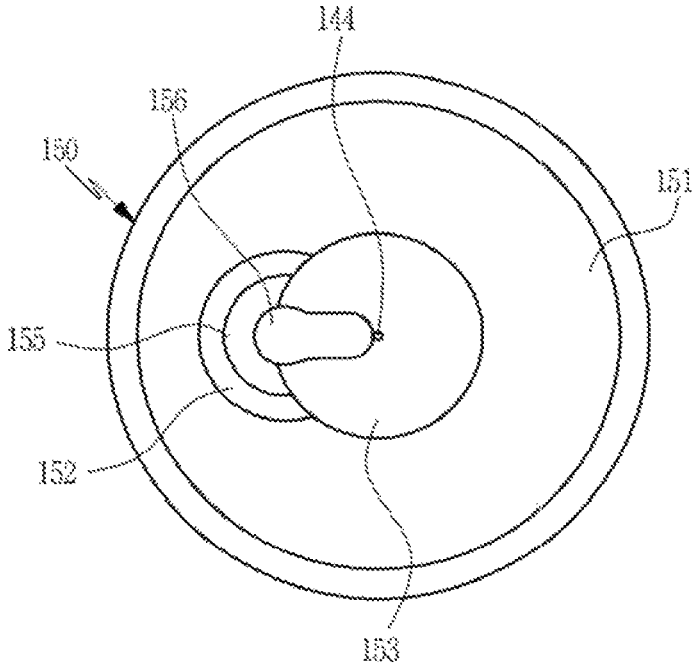
Figure 8B:
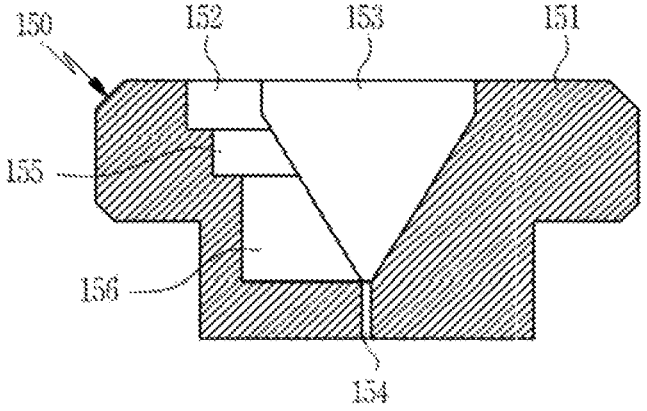

FIG. 1 shows the construction of a typical dispenser,

FIG. 2 is an enlarged cross-sectional view of a nozzle part shown in FIG. 1, FIG. 3*a* and FIG. 3*b* show constructions of a tappet and a nozzle according to a prior art, FIG. 4*a*-FIG. 4*b* show the construction of a nozzle according to a first embodiment of the present invention, in which FIG. 4*a* is a cross-sectional side view and FIG. 4*b* is a view for showing a service condition, FIG. 5*a*-FIG. 5*b* show the construction of a nozzle according to a second embodiment of the present invention, in which FIG. 5*a* is a cross-sectional side view and FIG. 5*b* is a plane view, FIG. 6*a*-FIG. 6*c* show the construction of a nozzle according to a third embodiment of the present invention, in which FIG. 6*a* is a cross-sectional side view, FIG. 6*b* is a plane view, and FIG. 6*c* is a view for showing a service condition, FIG. 7*a*-FIG. 7*b* show the construction of a nozzle according to a fourth embodiment of the present invention, in which FIG. 7*a* is a cross-sectional side view and FIG. 7*b* is a plane view, and FIG. 8*a*-FIG. 8*b* show the construction of a nozzle according to a fifth embodiment of the present invention, in which FIG. 8*a* is a cross-sectional side view and FIG. 8*b* is a plane view.

BRIEF EXPLANATION OF REFERENCE SIGNS

| | |
|---|---|
| 10: driving part | 20: coupling part |
| 30: nozzle part | 40: syringe part |
| 100: tappet | 101: leading end portion |
| 110, 120, 130, 140, 150: nozzle | |

DETAILED DESCRIPTION OF THE PREFERRED EMBODIMENT

Reference will be now made in detail to the preferred embodiments of the present invention with reference to the accompanying drawings.

First, in connection with adding reference signs to the constituent elements in each of the drawings, the same constituent elements have the same reference numerals as far as possible even though they are illustrated in different figures.

FIG. 4*a*-FIG. 4*b* show the construction of a nozzle according to a first embodiment of the present invention, in which FIG. 4*a* is a cross-sectional side view and FIG. 4*b* is a view for showing a service condition, First, a nozzle according to the present invention is applied to a dispenser, which includes includes a driving part 10, a coupling part 20 mounted on the bottom surface of the driving part 10, a nozzle part 30 mounted at the lower portion of the coupling part 20, and a syringe part 40 mounted on a side surface of the coupling part 20, as described above, such that a tappet, which carries out vibration motion and has a leading end portion 101 formed in a conical shape, is mounted on the lower end of the driving part 10 so as to be exposed and inserted into the nozzle part 30 through the coupling part 20, and the nozzle part 30 is provided with a nozzle on the bottom surface thereof. A nozzle 110 according to the present invention includes a funnel-shaped accommodation part 111 formed for maintaining a predetermined gap G from an outer circumferential surface of the leading end portion 101 of the tappet 100, a funnel groove 112 formed in the center of a bottom surface 111*a* of the funnel-shaped accommodation part 111 such that the leading end portion 101 of the tappet 100 is inserted into the funnel groove 112 by a predetermined length, and an injection hole 113 penetratingly formed in the center of the funnel groove 112.

In the nozzle 110 as structured above, liquid to be dispensed is discharged to the outside through the injection hole 113 as the tappet 100 moves forwards such that the front tip of the leading end portion 101 is inserted into the funnel groove 112 after the liquid to be dispensed is charged into the accommodation part 111 and the funnel groove 112 of the nozzle 110 through a gap around the tappet 100 (the first space part 35, see FIG. 2)

After the injection operation, the liquid to be dispensed staying in the gap G is introduced into the funnel groove 112 with speed at the moment when the tappet 100 moves backwards.

Therefore, the liquid to be dispensed is introduced into the funnel groove 112 through the accommodation part 111 with speed when the tappet 100 moves up and down such that a quantitative amount of the liquid to be dispensed can be injected, thereby improving dispensing quality.

FIG. 5*a*-FIG. 5*b* show the construction of a nozzle according to a second embodiment of the present invention, in which FIG. 5*a* is a cross-sectional side view and FIG. 5*b* is a plane view.

As shown in FIG. 5*a*-FIG. 5*b*, a nozzle 120, according to the second embodiment of the present invention, includes a funnel-shaped accommodation part 121 formed for maintaining a predetermined gap from an outer circumferential surface of the leading end portion 101 of the tappet 100, a funnel groove 122 formed in the center of a bottom surface 121*a* of the funnel-shaped accommodation part 121 such that the leading end portion 101 of the tappet 100 is inserted into the funnel groove 122 by a predetermined length, an injection hole 123 penetratingly formed in the center of the funnel groove 122, and an injection groove 124 formed in the inclined plane of the funnel groove 122 at one side of the bottom surface 121*a* of the funnel-shaped accommodation part 121 such that the liquid to be dispensed is introduced into the funnel groove 122.

Herein, at least one or more injection grooves 124, and preferably three injection grooves 124 are formed at a predetermined interval with respect to the injection hole 123.

The nozzle 120 as structured above provides the effect that the liquid to be dispensed is more rapidly charged into the funnel groove 121 through the injection grooves 124 when the liquid to be dispensed is charged into the funnel groove 122 through the accommodation part 121 of the nozzle 120.

Therefore, when the tappet operates to move back and forth, that is, when the tappet carries out the injection operation and the backward operation, the liquid to be dispensed is charged into the funnel groove 121 with speed so as to be injected at a high speed.

FIG. 6*a*-FIG. 6*c* show the construction of a nozzle according to a third embodiment of the present invention, in which FIG. 6*a* is a cross-sectional side view, FIG. 6*b* is a plane view, and FIG. 6*c* is a view for showing a service condition.

As shown in FIG. 6*a*-FIG. 6*c*, a nozzle 130, according to the third embodiment of the present invention, includes three first groove portions 132 having a circular shape and formed of a predetermined depth on the upper end portion of a main body 131 so as to be adjacent to each other, a funnel groove 133 formed of a predetermined depth down to a bottom surface 134 in the center portion thereof among the first groove portions 132 such that the leading end portion 101 of the tappet 100 is inserted into and comes into contact with the funnel groove 133 by a predetermined length, an injection hole 135 penetratingly formed in the center of the funnel groove 133, and a second groove portion 136 formed in the inclined plane of the funnel groove 133 at one side of each of the first groove portions 132 such that the liquid to be dispensed is introduced into the funnel groove 133.

Herein, at least one or more second groove portions 136, and preferably three second groove portions 136 are formed at a predetermined interval with respect to the injection hole 135 so as to join together in the injection hole 135 in the center.

The nozzle 130 as structured above provides the effect that the liquid to be dispensed is more rapidly charged into the funnel groove 133 through the second groove portions 136 when the liquid to be dispensed is charged into the funnel groove 133 through the first groove portions 132 of the nozzle 130.

FIG. 7*a*-FIG. 7*b* show the construction of a nozzle according to a fourth embodiment of the present invention, in which FIG. 7*a* is a cross-sectional side view and FIG. 7*b* is a plane view.

As shown in FIG. 7*a*-FIG. 7*b*, a nozzle 140, according to the fourth embodiment of the present invention, includes two first groove portions 142, 142 having a circular shape and formed of a predetermined depth on the upper end portion of a main body 141 so as to be adjacent to each other, a funnel groove 143 formed of a predetermined depth down to a bottom surface in the center portion thereof between the two circles of the first groove portions 142, which are adjacent to each other, such that the leading end portion 101 of the tappet 100 is inserted into and comes into contact with the funnel groove 143, an injection hole 144 penetratingly formed in the center of the funnel groove 143, second groove portions 145, 145 having a circular shape and formed of a predetermined depth inside the first groove portions 142, and a third groove portion 146 formed in the inclined plane of the funnel groove 143 at one side of each of the second groove portions 145, 145 such that the liquid to be dispensed is introduced into the funnel groove 143.

Herein, at least one or more third groove portions 146, and preferably three third groove portions 146 are formed at a predetermined interval with respect to the injection hole 144.

The nozzle 140 as structured above provides the effect that the liquid to be dispensed is more rapidly charged into the funnel groove 143 through the third groove portions 146 when the liquid to be dispensed is charged into the funnel groove 143 through the first groove portions 142 and the second groove portions 145 of nozzle 140.

FIG. 8*a*-FIG. 8*b* show the construction of a nozzle according to a fifth embodiment of the present invention, in which FIG. 8*a* is a cross-sectional side view and FIG. 8*b* is a plane view.

As shown in FIG. 8*a*-FIG. 8*b*, a nozzle 150, according to the fifth embodiment of the present invention, includes a first groove portion 152 having a circular shape and formed of a predetermined depth at one side of the upper end portion of a main body 151, a funnel groove 153 formed of a predetermined depth down to a bottom surface in the center portion thereof, which includes one side of the first groove portion 152, such that the leading end portion 101 of the tappet 100 is inserted into and comes into contact with the funnel groove 153, an injection hole 154 penetratingly formed in the center of the funnel groove 153, a second groove portion 155 having a circular shape and formed of a predetermined depth inside the first groove portion 152, and a third groove portion 156 formed in the inclined plane of the funnel groove 153 at one side of the second groove portion 155 such that liquid to be dispensed is introduced into the funnel groove 153.

The nozzle 150 as structured above provides the effect that the liquid to be dispensed is more rapidly charged into the funnel groove 153 through the third groove portion 156 when the liquid to be dispensed is charged into the funnel groove 153 through the first groove portion 152 and the second groove portion 155 of nozzle 150.

What is claimed is:

1. A dispenser nozzle for high pressure injection, applied to a dispenser which includes a driving part 10, a coupling part 20 and a nozzle part 30, such that a tappet 100, which carries out vibration motion and has a leading end portion 101 formed in a conical shape, is mounted on the lower end of the driving part 10 so as to be exposed and inserted into the nozzle part 30 through the coupling part 20, and the nozzle part 30 is provided with a nozzle 130 on the bottom surface thereof, the nozzle 130 comprising:

three first groove portions 132 having a circular shape and formed of a predetermined depth on the upper end portion of a main body 131 so as to be adjacent to each other;

a funnel groove 133 formed of a predetermined depth down to a bottom surface 134 in the center portion thereof among the first groove portions 132 such that the leading end portion 101 of the tappet 100 is inserted into and comes into contact with the funnel groove 133 by a predetermined length;

an injection hole 135 penetratingly formed in the center of the funnel groove 133; and a second groove portion 136 formed in the inclined plane of the funnel groove 133 at one side of each of the first groove portions 132 such that liquid to be dispensed is introduced into the funnel groove 133.

2. The dispenser nozzle for high pressure injection according to claim 1, wherein three second groove portions 136 are formed at a predetermined interval with respect to the injection hole 135.

* * * * *